US012655576B2

(12) United States Patent
Yan

(10) Patent No.: US 12,655,576 B2
(45) Date of Patent: Jun. 16, 2026

(54) PUMPLESS STEAM IRONING DEVICE

(71) Applicant: NINGBO KAIBO GROUP CO., LTD., Ningbo (CN)

(72) Inventor: Jiebo Yan, Ningbo (CN)

(73) Assignee: NINGBO KAIBO GROUP CO., LTD., Ningbo (CN)

( * ) Notice: Subject to any disclaimer, the term of this patent is extended or adjusted under 35 U.S.C. 154(b) by 0 days.

(21) Appl. No.: 19/018,881

(22) Filed: Jan. 13, 2025

(65) Prior Publication Data

US 2025/0230603 A1 Jul. 17, 2025

(30) Foreign Application Priority Data

Jan. 17, 2024 (CN) ..... 202420112120.X

(51) Int. Cl.
*D06F 75/14* (2006.01)
*D06F 75/20* (2006.01)
*D06F 75/34* (2006.01)

(52) U.S. Cl.
CPC ..... *D06F 75/14* (2013.01); *D06F 75/20* (2013.01); *D06F 75/34* (2013.01)

(58) Field of Classification Search
CPC ..... D06F 75/14; D06F 75/30; D06F 75/20; D06F 75/24; D06F 75/34
See application file for complete search history.

(56) References Cited

U.S. PATENT DOCUMENTS 3,986,282 A * 10/1976 Nelson ..... D06F 75/14 38/77.83
6,986,217 B2 * 1/2006 Leung ..... D06F 73/00 68/222

FOREIGN PATENT DOCUMENTS

CN 219470502 U * 8/2023
EP 3868952 A1 * 8/2021 ..... D06F 73/00
WO WO-2023089283 A1 * 5/2023 ..... D06F 73/00

* cited by examiner

*Primary Examiner* — Nathan E Durham
(74) *Attorney, Agent, or Firm* — MUNCY, GEISSLER, OLDS & LOWE, P.C.

(57) ABSTRACT

A pumpless steam ironing device belongs to handheld ironing devices. A water tank is connected to an atomizing device by means of a water passage, and the water passage, the water tank and the atomizing device are configured in a manner that the water passage is lower than the water tank when the ironing panel is in a vertical state or a horizontal state to allow water to automatically flow from the water tank into the atomizing device via the water passage. In addition, a valve is turned on or off by means of a control portion to open or close the water passage, and water can be delivered without a water pump.

8 Claims, 3 Drawing Sheets

PUMPLESS STEAM IRONING DEVICE

BACKGROUND OF THE INVENTION

1. Technical Field

The invention belongs to handheld ironing devices, and particularly relates to a pumpless steam ironing device.

2. Description of Related Art

Existing steam ironing devices, such as various handheld steamers, adopt a water pump to deliver water from a water tank to an atomizing device, so the manufacturing cost is high; in addition, because electricity will be consumed when the water pump delivers water, for an ironing device that can work by means of a storage battery without an external power supply, the battery life of will be shortened. The use of the water pump leads to more fault points of products.

A traditional electric iron is not provided with a water pump, a handle is arranged at the top of the electric iron, a soleplate is arranged at the bottom of the electric iron, a water tank is located above the soleplate, water is delivered from the water tank to an atomizing device via a water outlet in a front portion of the water tank, and when the soleplate is erected, water can no longer be delivered from the water tank into the atomizing device. Therefore, such an electric iron is only suitable for horizontal ironing (ironing a surface in a horizontal state), and usage of the electric iron is limited.

BRIEF SUMMARY OF THE INVENTION

To overcome the defects that existing ironing devices adopt a water pump to deliver water and cannot make a balance between the manufacturing cost and flexible ironing, the technical issue and technical task to be settled by the invention is to provide a pumpless steam ironing device, which has flexible ironing functions on the premise that the product structure is simplified.

To fulfill the above objective, the invention provides a pumpless steam ironing device, comprising a main body, a handle, a water tank, an atomizing device and an ironing panel, wherein the water tank is connected to the atomizing device by means of a water passage; when the ironing panel is in a vertical state or a horizontal state, the water passage is lower than the water tank to allow water to automatically flow from the water tank into the atomizing device via the water passage; and the water passage is provided with a valve, and the valve comprises a control portion, which extends out of the main body and used for turning on or off the valve.

According to the pumpless steam ironing device, when the ironing panel is in the vertical state or the horizontal state, the water passage is lower than the water tank, and water automatically flows from the water tank into the atomizing device via the water passage, such that the pumpless ironing device can be used for hanging ironing, horizontal ironing, or ironing in other positions, thus being easy to use. In addition, the ironing device can deliver water without a water pump, such that control of the water pump and pipelines used for delivering water by means of the water pump are avoided, the manufacturing cost is reduced, and fault points of the pumpless steam ironing device are reduced.

Preferably, the handle extends in an up-down direction, the main body is located at an upper end of the handle, the water tank is arranged at an upper end of the atomizing device and located above the main body, the water tank and the handle are located on an upper side and a lower side of the main body respectively, the ironing panel is located at a front end of the main body, and the atomizing device is located in the main body. By means of such a structural configuration, users can hold the handle by hand to freely switch the pumpless steam ironing device between a horizontal ironing position and a hanging ironing position, and smooth water delivery is guaranteed.

To allow users to add water into the water tank easily, the water tank is detachably assembled on the main body and provided with a water outlet, the water passage is arranged in the main body, and an upper end of the water passage is detachably connected to the water outlet. In this way, the water tank can be easily detached from the main body, and then water can be added into the water tank.

To ensure that water is delivered smoothly, the water passage and the atomizing device are located on a front portion of the main body, and the water outlet is located in a bottom side of a front portion of the water tank. By means of such a structure, the water passage is lower than the water tank when the ironing panel is in the vertical state or the horizontal state, such that water can automatically flow from the water tank into the atomizing device via the water passage.

To ensure that all water in the water tank can be delivered to the atomizing device, a bottom of the water tank is inclined to guide water to flow from the water tank to the water passage.

To ensure that water is delivered smoothly, the water tank is provided with an air hole, and the air hole is configured to be located at a high position of the water tank when the ironing panel is in the vertical state or the horizontal state.

To close or open the water passage, the valve comprises a valve port, a valve plug and a valve rod, the valve port is arranged in a path in the water passage, the valve plug is arranged on the valve rod and located at the valve port, the valve rod is movably configured on the main body and used for driving the valve plug to block or open the valve port, the valve rod extends out of the main body, and the control portion is arranged at an outer end of the valve rod. In this way, the valve rod can be controlled to move to open or close the water passage.

Particularly, the water passage extends in the up-down direction, the valve port is a connection cavity intersecting with the water passage, the valve rod is arranged in a front-back direction, the valve plug is located at a front end of the valve rod, and the control portion is arranged at a back end of the valve rod. In this way, the control portion keeps away from the handle to be held by one hand of users and will not be mistakenly operated by the hand holding the handle, and the users can perform operations by the other hand.

To control the flow rate of water, the valve port is provided with a throttle cavity deviating from the water passage. In addition, because the throttle cavity deviates from the water passage, a large buffer space is formed, and the air pressure applied to the water flow in the water passage when the atomizing device generates steam can be reduced, thus ensuring that water is delivered smoothly.

To ensure that water is delivered smoothly, the water tank is provided with a water outlet connected to the water passage, and a diameter of the water outlet is less than a diameter of the water passage. In this way, the water pressure produced by water stored in the water tank can counteract the air pressure produced when the atomizing device generates steam, and water can smoothly flow from the water tank into the atomizing device.

To reduce fault points, a stationary member is configured in the main body, and the water passage is arranged in the stationary member. In this way, pipe connection is reduced, and water leakage is avoided.

In the invention, the water tank is connected to the atomizing device by means of the water passage, and the water passage, the water tank and the atomizing device are configured in a manner that the water passage is lower than the water tank when the ironing panel is in the vertical state or the horizontal state to allow water to automatically flow from the water tank into the atomizing device via the water passage, such that the ironing device can be used for hanging ironing, horizontal ironing, or ironing in other positions, thus being easy to use. In addition, the valve is turned on or off by means of the control portion to open or close the water passage, and water can be delivered without a water pump, such that control of the water pump and pipelines required for delivering water by the water pump are avoided, the manufacturing cost is reduced, and fault points of the pumpless steam ironing device are reduced.

REFERENCE SIGNS

100, main body; 101, stationary member; 102, water passage; 103, valve; 104, valve port; 105, throttle cavity; 106, valve plug; 107, valve rod; 108, control portion;

100, handle;

300, water tank; 301, water outlet; 302, bottom; 303, air hole;

400, atomizing device;

500, ironing panel.

DETAILED DESCRIPTION OF THE INVENTION

To make the technical means, characteristics of creation, purpose and effectiveness of attainment of realizing the present utility model easy to understand, the present utility model is further clarified in combination with the embodiments.

To better clarify the objectives, technical solutions and advantages of the invention, the technical solutions in the embodiments of the invention will be clearly and completely described below in conjunction with the accompanying drawings of these embodiments. Obviously, the embodiments described below are merely illustrative ones, and are not all possible ones of the invention. All other embodiments obtained by those ordinarily skilled in the art according to the following ones without creative labor should also fall within the protection scope of the invention.

Terms "comprise" and "has" and any variants thereof in the description and claims of the invention are intended to indicate non-exclusive inclusion. For example, a method or product comprising a series of technical features should not be limited to the technical features that are clearly listed, and may also comprise other technical features that are not listed clearly and may be included in the method or product.

In the description of the invention, it should be understood that terms such as "upper", "lower", "front" and "back" are used to indicate directional or positional relations based on the accompanying drawings merely for facilitating and simplifying the description of the invention, do not indicate or imply that devices or elements referred to must be in a specific direction or be configured and operated in a specific direction, and thus should not be construed as limitations of the invention. Wherein, "upper" is opposite to "lower", and "front" is opposite to "back".

The invention is described in detail below in conjunction with specific embodiments and accompanying drawings.

Figure 1:
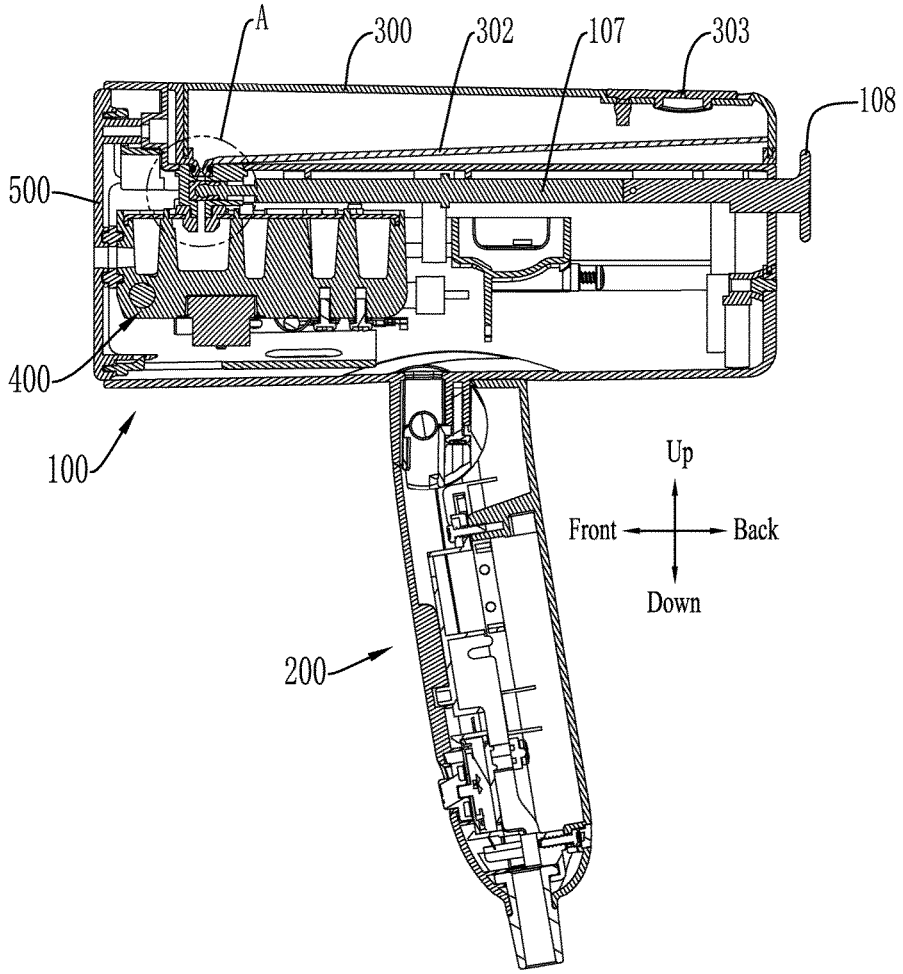
FIG. 1 is a sectional structural view of a pumpless steam ironing device according to the invention.
Figure 5:
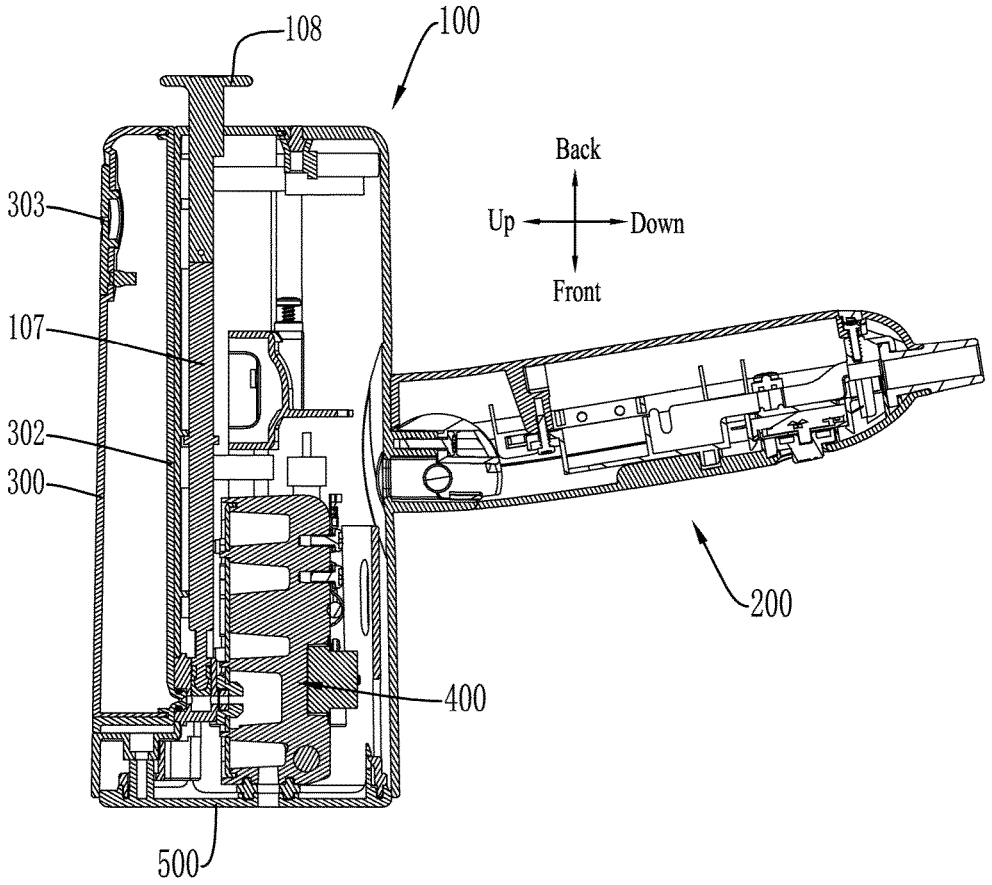
FIG. 5 is a schematic diagram of the ironing device shown in FIG. 1 in a horizontal ironing position.

As shown in FIGS. 1 and 5, a pumpless steam ironing device comprises a main body 100, a handle 200, a water tank 300, an atomizing device 400 and an ironing panel 500.

The handle 200 extends in an up-down direction. The main body 100 is located at an upper end of the handle 200 and extends in a front-back direction. When manufactured, the main body and the handle may be integrally connected, or manufactured separately and then assembled together.

The ironing panel 500 is located at a front end of the main body 100 and provided with steam outlets. A mounting position is formed on a back side of the ironing panel 500 and an upper side of the main body 100.

The atomizing device 400 is located at a front position inside the main body 100.

The water tank 300 is located above the main body 100, and the water tank 300 and the handle 200 are located on upper and lower sides of the main body 100 respectively. The water tank 30 is mounted at the mounting position, a front end of the water tank 300 is close to the ironing panel 500, and a back end of the water tank 300 is flush with a back end of the main body 100, such that the water tank 300 is approximately as long as the main body 100. When water is stored in the water tank, the weight of water can be uniformly distributed in the length direction (front-back direction) of the main body, such that the situation that the burden of the hands of users is increased due to a large deviation of the center of gravity of the ironing device when the handle is held by hand is avoided. A bottom 302 of the water tank 300 is inclined to guide water to flow from the water tank to a water passage. As shown in FIGS. 1 and 5, the water tank 300 is provided with an air hole 303, and the air hole 303 is located at an upper end of a back portion of the water tank 300. When the ironing panel is in a vertical state or in a horizontal state, the air hole is located at a high position of the water tank. A water outlet 301 is located in a bottom side of a front portion of the water tank 300, such that the air hole 303 and the water outlet 301 are located in two extreme positions of the water tank respectively. The water outlet is used for discharging water, and the air hole is used for ventilation. The air hole can assist the water outlet in discharging water and can also prevent water from leaking via the water outlet. The diameter of the water outlet is less than the diameter of the water passage.

A stationary member 101 is configured in the main body 100, and the stationary member 101 is arranged on the back side of the ironing panel 500 and located above the atomizing device 400. The water passage 102 extending in the up-down direction is arranged in the stationary member 101 and located in a front portion of the main body 100. A lower end of the water passage 102 is fixedly connected to a water inlet of the atomizing device 400. An upper end of the water passage 102 is detachably connected to the water outlet 301 of the water tank. In this way, the water tank is connected to the atomizing device by means of the water passage, and water can be delivered from the water tank into the atomizing device. When water needs to be added to the water tank, the water tank can be detached from the main body.

Based on the abovementioned assembly relation, when the ironing panel 500 is in a vertical state (hanging ironing position) shown in FIG. 1 or in a horizontal state (horizontal ironing position) shown in FIG. 5, the water passage 102 is lower than the water tank 300 to allow water to automatically flow from the water tank 300 into the atomizing device 400 via the water passage 102.

The water passage 102 is provided with a valve 103. The valve 103 comprises a control portion 108, which extends out of the main body and is used for turning on or off the valve. When the valve is turned on by means of the control portion, the water passage will be opened, and water is delivered from the water tank to the atomizing device. When the valve is turned off by means of the control portion, the water passage will be closed, and water will not be delivered from the water tank into the atomizing device.

The valve 103 comprises a valve port 104, a valve plug 106 and a valve rod 107. The valve port 104 is located in a path in the water passage 102. The valve plug 106 is arranged on the valve rod 107 and located at the valve port 104. The valve rod 107 is movably configured on the main body and used for driving the valve plug to block or open the valve port. The valve rod 107 is arranged in the front-back direction and extends backwards out of the main body 100, and the control portion 108 is arranged at a back end of the valve rod 107. The valve port 104 is a connection cavity intersecting with the water passage 102, and the valve port 104 is provided with a throttle cavity 105 deviating from the water passage 102. The valve plug 106 is located at a front end of the valve rod 107.

Figure 2:
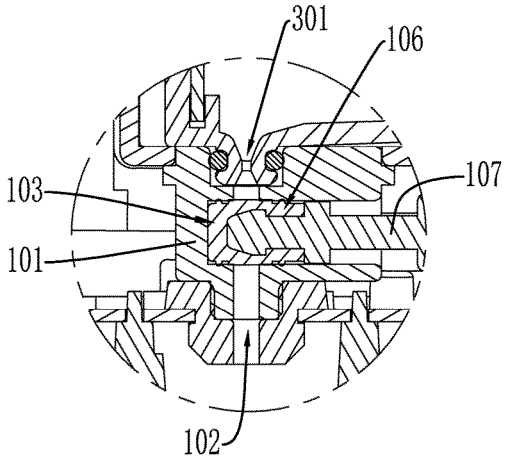
FIG. 2 is an enlarged view of part A in FIG. 1.
Figure 3:
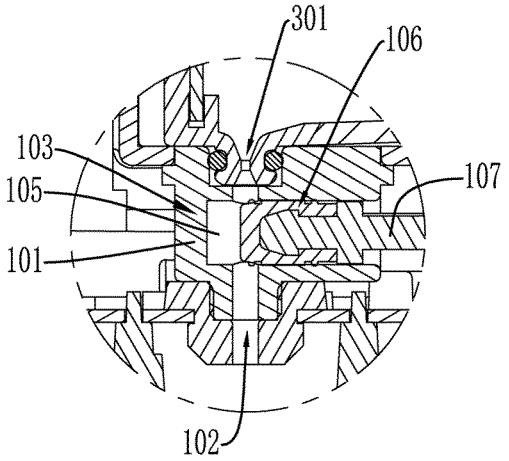
FIG. 3 is a schematic diagram in a case where a valve port shown in FIG. 2 is half opened.
Figure 4:
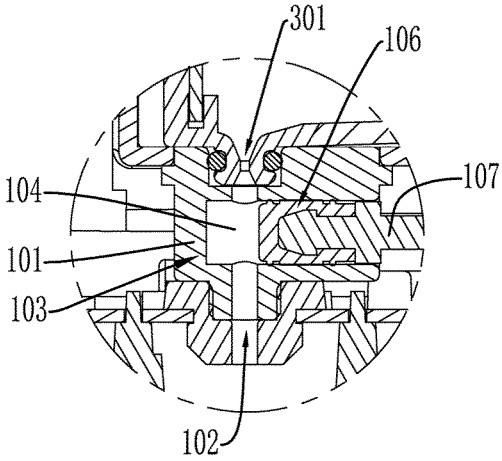
FIG. 4 is a schematic diagram in a case where the valve port shown in FIG. 2 is completely opened.

As described above, no matter whether the ironing panel 500 is in the vertical state (hanging ironing position) shown in FIG. 1 or in the horizontal state (horizontal ironing position) shown in FIG. 5, the water passage 102 is lower than the water tank 300 to allow water to automatically flow from the water tank into the atomizing device via the water passage. In actual use, the ironing panel may be configured at any angle between the vertical state and the horizontal state. In addition, the valve rod 107 may be moved forwards or backwards by means of the control portion 108 to open or close the water passage. As shown in FIG. 2, the valve port 104 is completely blocked by the valve plug 106, the water passage 102 is closed, and water is not delivered from the water tank into the atomizing device. When the valve rod 107 is moved backwards from the state shown in FIG. 2, the valve plug 106 will move backwards synchronously until the valve port 104 is half opened, as shown in FIG. 3, and at this moment, the water passage 102 is opened and throttled, so water is delivered at a low rate. When the valve rod 107 is further moved backwards from the state shown in FIG. 3, the valve plug 106 will move backwards synchronously until the valve port 104 is completely opened, as shown in FIG. 4, and at this moment, the water passage 102 is completely opened and not throttled, so water is delivered at a high rate.

As described above, the ironing device delivers water by means of the water passage that can be opened or closed rather than a water pump, such that control of the water pump and pipelines required for delivering water by the water pump are avoided, the manufacturing cost is reduced, and fault points of the pumpless steam ironing device are reduced. In addition, the pumpless steam ironing device can be used for hanging ironing, horizontal ironing, or ironing in other positions, thus being easy to use.

During ironing, water flows from the water tank into the atomizing device via the water passage, the atomizing device heats the water to atomize the water into steam, and the steam is released via the steam outlets in the ironing panel to be used for ironing.

What is claimed is:

1. A pumpless steam ironing device, comprising:

a main body;

a handle;

a water tank;

an atomizing device; and an ironing panel, wherein the water tank is connected to the atomizing device by means of a water passage, wherein, when the ironing panel is in a vertical state or a horizontal state, the water passage is lower than the water tank to allow water to automatically flow from the water tank into the atomizing device via the water passage; and the water passage is provided with a valve, wherein the valve comprises a control portion, which extends out of the main body and used for turning on or off the valve, wherein the handle extends in an up-down direction, the main body is located at an upper end of the handle, the water tank is arranged at an upper end of the atomizing device and located above the main body, the water tank and the handle are located on an upper side and a lower side of the main body respectively, the ironing panel is located at a front end of the main body, and the atomizing device is located in the main body, wherein the valve comprises a valve port, a valve plug and a valve rod, the valve port is arranged in a path in the water passage, the valve plug is arranged on the valve rod and located at the valve port, the valve rod is movably configured on the main body and used for driving the valve plug to block or open the valve port, the valve rod extends out of the main body, and the control portion is arranged at an outer end of the valve rod, and wherein the water passage extends in the up-down direction, the valve port is a connection cavity intersecting with the water passage, the valve rod is arranged in a front-back direction, the valve plug is located at a front end of the valve rod, and the control portion is arranged at a back end of the valve rod.

2. The pumpless steam ironing device according to claim 1, wherein the water tank is detachably assembled on the main body and provided with a water outlet, the water passage is arranged in the main body, and an upper end of the water passage is detachably connected to the water outlet.

3. The pumpless steam ironing device according to claim 2, wherein the water passage and the atomizing device are located on a front portion of the main body, and the water outlet is located in a bottom side of a front portion of the water tank.

4. The pumpless steam ironing device according to claim 1, wherein a bottom of the water tank is inclined to guide water to flow from the water tank to the water passage.

5. The pumpless steam ironing device according to claim 1, wherein the water tank is provided with an air hole, and the air hole is configured to be located at a high position of the water tank when the ironing panel is in the vertical state or the horizontal state.

6. The pumpless steam ironing device according to claim 1, wherein the valve port is provided with a throttle cavity deviating from the water passage.

7. The pumpless steam ironing device according to claim 1, wherein the water tank is provided with a water outlet connected to the water passage, and a diameter of the water outlet is less than a diameter of the water passage.

8. The pumpless steam ironing device according to claim 1, wherein a stationary member is configured in the main body, and the water passage is arranged in the stationary member.

* * * * *